United States Patent [19]

Wang

[11] Patent Number: 5,074,483

[45] Date of Patent: Dec. 24, 1991

[54] RECOIL WINDLASS

[76] Inventor: Wen-Chang Wang, No. 208-13, Shang-Lun Village, Jen-Te Hsiang, Tainan Hsien, Taiwan

[21] Appl. No.: 562,918

[22] Filed: Aug. 3, 1990

[51] Int. Cl.[5] ..... B65H 75/48

[52] U.S. Cl. ..... 242/107; 242/107.4 R; 242/107.6; 242/107.4 C

[58] Field of Search ..... 242/107, 107.1, 107.11, 242/107.12, 107.13, 107.14, 107.15, 107.3, 107.4 R, 107.4 C, 107.5, 107.6, 107.7

[56] References Cited

U.S. PATENT DOCUMENTS

| | | | |
|---|---|---|---|
| 511,967 | 1/1894 | Pitel | 242/107.14 |
| 2,659,573 | 11/1953 | Smith | 242/107.4 R |
| 3,790,099 | 2/1974 | Beller | 242/107.4 R |
| 3,952,967 | 6/1976 | Barile et al. | 242/107.4 R |
| 4,534,520 | 8/1985 | Yanagihara | 242/107.6 X |

*Primary Examiner*—John M. Jillions

*Attorney, Agent, or Firm*—Morton J. Rosenberg; David I. Klein

[57] ABSTRACT

A recoil windlass is provided with a casing, a reel wound with a wire having a hook end for suspending a hand tool, a hub member nonrotatably and axially mounted in the casing and formed with an internally threaded passage and a recoil spring mounted on the hub member with an inner end anchored to the hub member and an outer end anchored to the reel member so as to retract the wire into a coiled position in the casing under the bias of the recoil spring when the wire is released from an extended position. A nut is threaded into the passage with a leading end frictionally contacting a shaft means axially movable during rotation of the reel member through a thread engagement with the passage of the hub member.

4 Claims, 3 Drawing Sheets

RECOIL WINDLASS

BACKGROUND OF THE INVENTION

This invention relates to a windlass and more particularly to a recoil windlass for hoisting hand tools.

Recoil windlass for hoisting hand tools such as electric hand drills and pneumatic hand drills in a workshop is widely used for facilitating assembly operations by suspending said hand tools with a rope or cable at a height where the hand tools are easily accessible to workers. Said hand tool is pulled down to a working position and is automatically retracted to its suspending position by means of the recoil windlass. It is difficult for said known recoil windlass to adjust its proper extending length for satisfactorily accomodating a worker's height or working demands.

SUMMARY OF THE INVENTION

It is therefore a primary object of the present invention to provide a recoil windlass which is easy in adjusting its extending length so as to automatically retract a suspending hand tool up to a position accessible to its user.

Other objects will be in part obvious and in part pointed out more in detail hereinafter.

The invention accordingly consists in the features of construction, combination of elements and arrangement of parts which will be exemplified in the construction hereafter set forth.

DETAILED DESCRIPTION OF THE PREFERRED EMBODIMENTS

Figure 1:
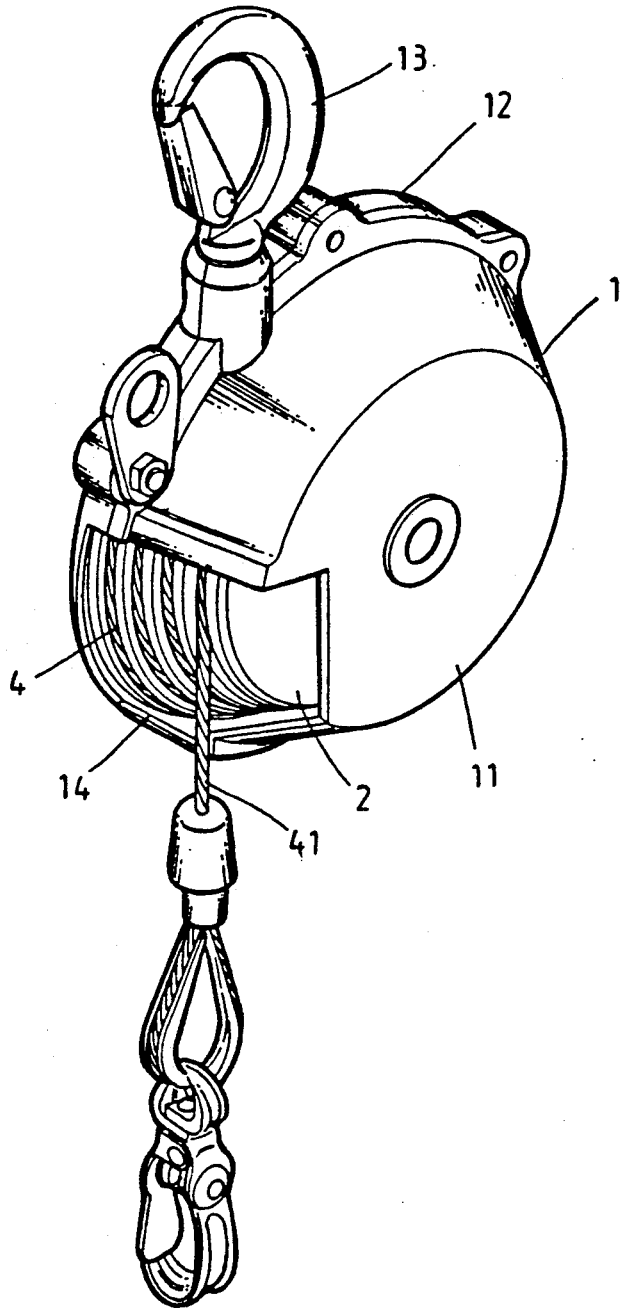
FIG. 1 is a perspective view of a recoil windlass according to the present invention.

Referring to the drawing in detail, FIG. 1 illustrates a recoil windlass embodying the present invention comprising a drum-shaped casing 1 including mating front cover 11 and rear cover 12 and being formed with an opening 14, a reel 2 rotatably mounted with the casing 1, a wire 4 being wound on the reel 2 with an outer end 41 thereof extending downwardly through the opening 14 of the casing 1 and a hook device 13 secured on top of the casing 1 for hanging the recoil windlass at a relatively high position.

Figure 3:
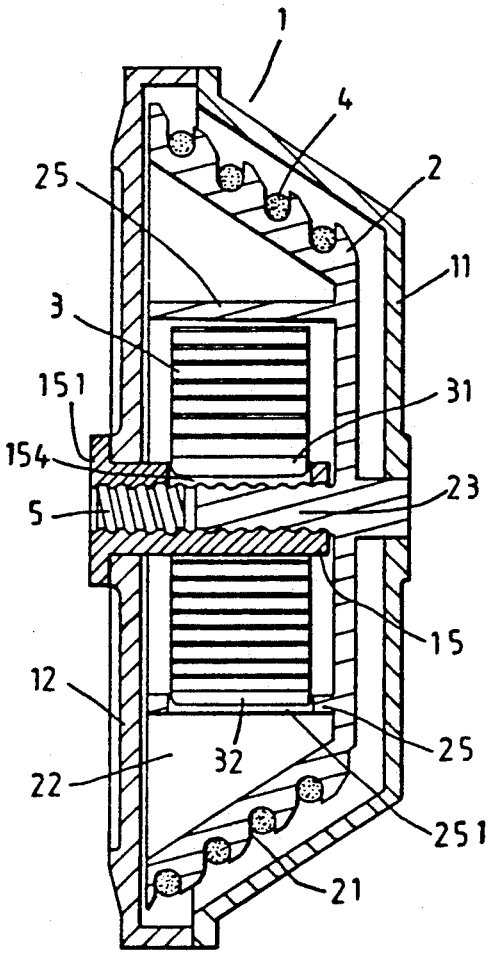
FIG. 3 is a cross-sectional view showing internal construction of a first preferred embodiment of the present invention.

Referring to FIG. 3 said front and rear covers 11, 12 are joined together to define a chamber for receiving the reel 2 of which the circumferential surface is formed with spiral grooves 21 for winding the wire 4 therein. Said reel 2 is provided with an axle 23 which includes a circular projection extending axially outwardly and being rotatably received in an aperture formed in a central portion of the front cover 11 of the casing 1, and a major portion thereof extending axially inwardly and formed with external thread.

A hub 15 is nonrotatably received in an aperture formed in a central portion of the rear cover 12. Said hub 15 is formed with a central passage extending axially and formed with an inner thread, which is intermeshable with the external thread of the axle 23 of the reel 2, therethrough. A recoil spring 3 is mounted on the hub 15 in a chamber 22 which is defined by an annular flange 25 which extends inwardly from the reel 2 for confining the recoil spring 3 to prevent it from unwinding. The inner end of the recoil spring 3 is anchored to the hub 15 by being inserted in a nonradial slot 154 and the outer end 32 thereof is anchored to the reel 2 by being inserted in a slot 251 formed in the annular flange 25 so that wire 4 will be automatically retracted into coiled position in the spiral grooves 21 of the reel 2 under the bias of the recoil spring 3 when the wire 4 is released from any of its extended positions.

In assembly, the reel 2 is rotatably mounted in the casing 1 by threading a predetermined length of the externally threaded axle 23 from one end into the central passage of the hub 15 and inserting the projection of the axle 23 into the aperture of the front cover 11. A nut 5 is threaded from another end into the central passage of the hub 15 until its leading end abuts against adjacent end of the axle 23 so as to preset an extending length of wire wound on the reel 2.

In operation, the outer end 41 of the wire 4 is pulled downwardly to drive the reel 2 rotating with respect to the hub 15. Due to the thread engagement between axle 23 of the reel 2 and the hub 15, the rotating reel 2 will move sideways with end of the axle 23 separating away from the leading end of the nut 5. When the wire 4 is released from its extended position, as aforementioned, it will be automatically retracted into coiled position in the spiral grooves of the reel 2 under the bias of the recoil spring 3 that reversely rotates the reel 2 to retract it. The reel 2 stops rotating as the wire 4 is fully retracted by means of frictional contact between adjacent end surfaces of the nut 5 and the axle 23.

The extending length of the wire 4 can be adjusted according to height or working demands of a worker by threading the nut 5 further inwardly into the central passage of the hub 15 or slightly retracting the nut 5 therefrom.

Figure 2:
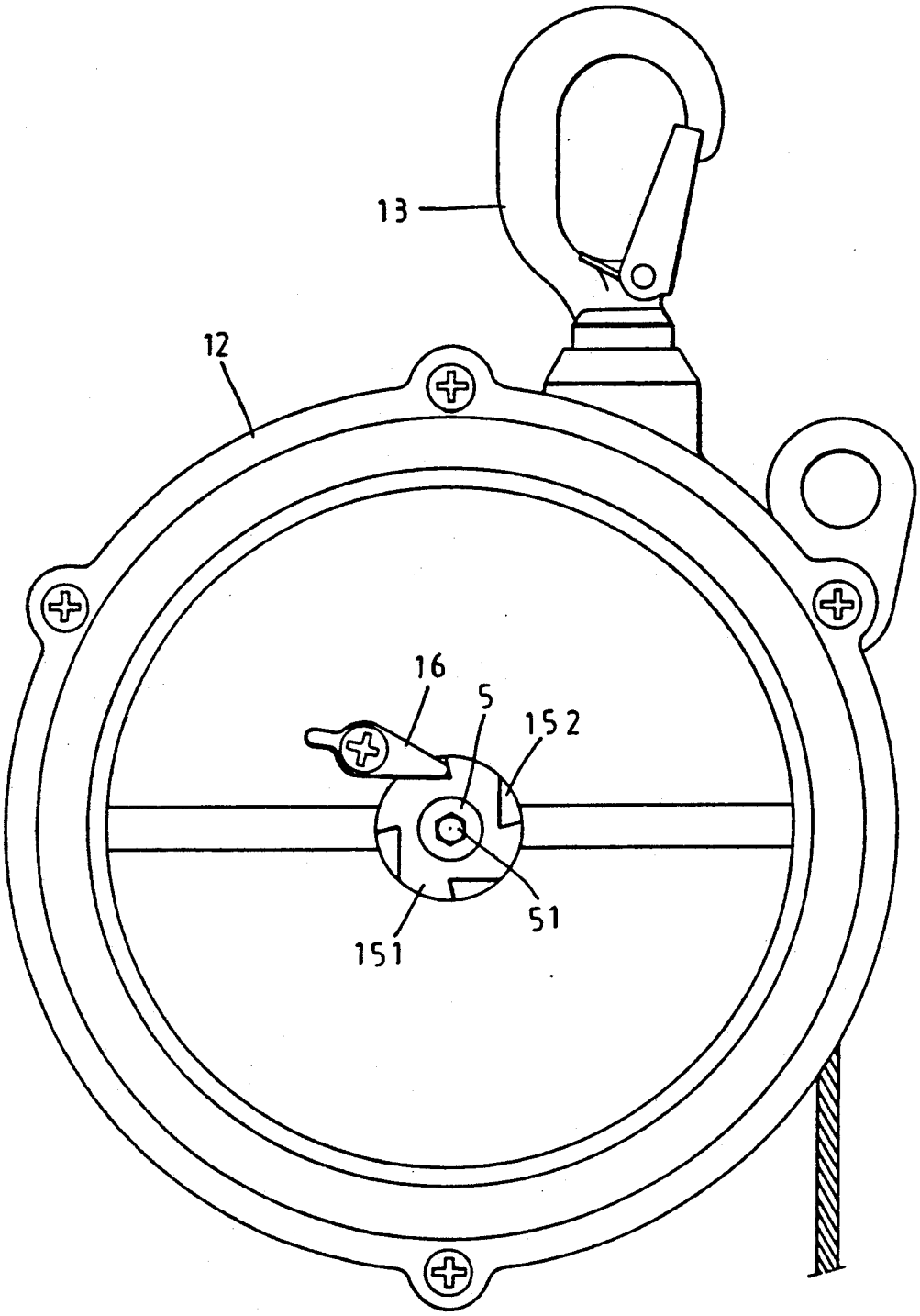
FIG. 2 is a rear side view of the recoil windlass of the present invention shown in FIG. 1.

The recoil spring 3 can be adjusted to a proper level of tension for satisfactory performance of the windlass by means of a latching mechanism. As shown in FIG. 2, outer end of the hub 15 is provided with an annular flange 151 which is formed with a plurality of notches 152 distributed circumferentially at equal intervals. A hexagonal recess 51 is formed in central portion of a head of the nut 5 for threading operation to adjust the extending length of the wire 4 by means of a known hexagonal key (not shown). Said annular flange 151 can be manually operated to wind tight of the recoil spring 3 and a catch 16 is pivoted nonaxially on the rear cover 12 for locking the hub 15 to maintain the recoil spring 3 in its properly tightened state by inserting the catch 16 into a corresponding notch 152.

Figure 4:
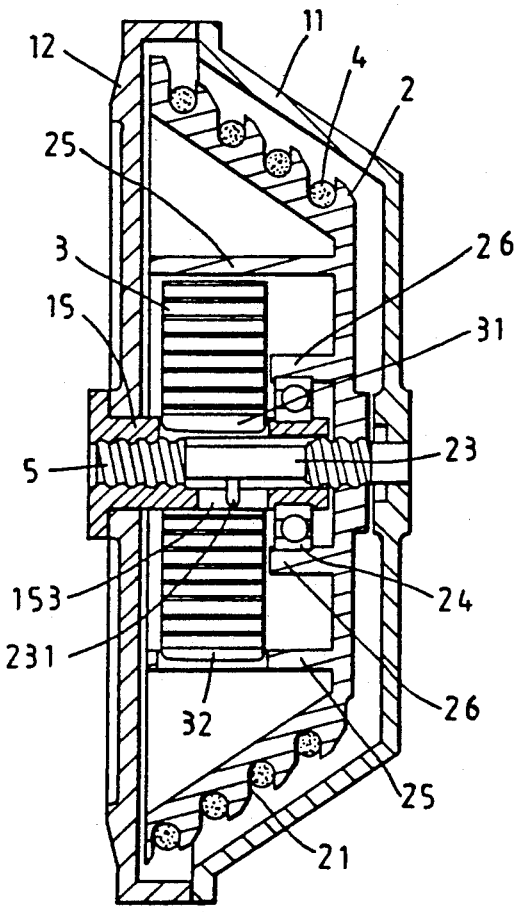
FIG. 4 is a cross-sectional view showning internal construction of a second preferred embodiment of the present invention.

FIG. 4 illustrates an alternating embodiment according to the present invention. This second embodiment is similar in construction to the first embodiment shown in FIG. 3 and comprises also mating front cover 11 and rear cover 12 which are joined together to define a chamber for rotatably mounting a reel 2. Spiral grooves 21 are formed in circumferential surface of the reel 2 for winding a wire 4. A recoil spring 3 is mounted on a hub 15 with its inner end 31 anchored to the hub 15 and its outer end 32 anchored to the reel 2 which is provided with an annular flange 25 for confining the recoil spring 3 to prevent it from unwinding.

The hub 15 is formed with a second nonradial slot 153 and a central passage which extends axially therethrough and is partially threaded with an inner thread in one end portion into which a nut 5 is threaded for presetting extending length of the wire 4. A shaft 23 has a nonthreaded end slidably received in an aperture of the front cover 11, another nonthreaded end extending inwardly into the central passage of the hub 15 and being provided with a downwardly projecting leg 231 extending into the second slot 153 of the hub 15 to thereby prevent relative rotation of the shaft 23 with respect to the reel 2, and an externally threaded portion between said two nonthreaded ends. The reel 2 is formed with an aperture threaded with inner thread, which is intermeshable with the external thread of the shaft 23, and a second annular flange 26 for rotatably mounting the reel 2 on the hub 15 by means of a ball bearing 24.

In operation, the outer end 41 of the wire 4 is pulled downwardly to drive the reel 2 to rotate with respect to the shaft 23 and the hub 15. Due to the thread engagement between the reel 2 and the shaft 23, the shaft 23 is forced to move axially away from the nut 5. When the wire 4 is released from its extended position, the wire 4 is automatically retracted into its coiled position in a manner similar to the first embodiment shown in FIG. 3.

While the invention has been described with what is presently considered to be the most practical and preferred embodiments, it is to be understood that the invention is not to be limited to the disclosed embodiment, but on the contrary, is intended to cover various modifications and equivalent arrangements.

What is claimed is:

1. A recoil windlass comprising:

a casing having a front cover and a rear cover defining a chamber therein and a side opening;

a reel member mounting in the chamber of the casing and having an axle including an annular projection being rotatably and slidably received in an aperture formed in the front cover and a portion formed with an external thread;

a wire wound on the reel and having an outer end extending outwardly from the casing through the side opening thereof, whereby said outer end can be pulled from a coiled position to an external position to drive the reel member to rotate;

a hub member nonrotatably received in an aperture formed in the rear cover and having an inner passage extending therethrough and toward the aperture of the front cover and formed with an inner thread engaging the external thread of the axle of the reel member to rotatably and axially movably support the reel member;

a nut engageable with the inner passage of the hub and being threaded into the inner passage with a leading end frictionally contacting an adjacent end of the axle of the reel member while the wire is located in its coiled position; and a recoil spring received in the chamber and mounting on the hub with an inner end thereof connecting the hub and an outer end thereof connecting the reel member to retract the wire from its extended position into its coiled position by reversely rotating the reel to move the axle through the thread engagement between the axle and the inner passage of the hub back to the position where the leading end of the nut frictionally contacts the adjacent end of the axle.

2. A recoil windlass as claimed in claim 1 wherein a circumferential surface of the reel is formed therein with spiral grooves for receiving wound wire.

3. A recoil windlass as claimed in claim 1 wherein the reel member is provided with an annular flange projecting axially over the recoil spring for confining the recoil spring to prevent it from unwinding.

4. A recoil windlass comprising:

a casing having a front cover and a rear cover defining a chamber therein and a side opening;

a reel member mounting in the chamber and having an annular flange projecting axially and an aperture formed with an inner thread;

a wire wound on the reel member and having an outer end extending outwardly from the casing through the side opening thereof, whereby said outer end can be pulled to drive the reel member to rotate;

a hub member nonrotatably received in an aperture formed in the rear cover and having an inner passage extending therethrough and formed with an inner thread in an end portion thereof;

a nut threadedly engageable with the inner passage of the hub;

a ball bearing member secured between the annular flange of the reel member and an end portion of the hub member for rotatably supporting the reel member on the hub member;

a shaft member having a nonthreaded end nonrotatably and axially slidably received in an aperture formed in the front cover, a portion formed with an external thread engaging the inner thread of the aperture of the reel member to rotatably supporting the reel member, and another end portion opposed to the nonthreaded end, extending into the inner passage of the hub member and formed with a leg member extending into the slot of the hub member to fix the shaft member against rotation relative to said hub member with an adjacent end of the shaft member frictionally contacting a leading end of the nut while the wire is located in its coiled position; and a recoil spring received in the chamber and mounting on the hub with an inner end thereof connecting the hub member and an outer end thereof connecting the reel member to retract the wire from its extended position into its coiled position by reversely rotating the reel to move the shaft member through a thread engagement between the shaft member and the aperture of the reel member back to the position where the leading end of the nut frictionally contacts the adjacent end of the shaft member.

* * * * *